United States Patent [19]

Arndt

[11] 4,320,072

[45] Mar. 16, 1982

[54] COOLING TOWER SPRAY NOZZLE

[75] Inventor: William A. Arndt, Healdsburg, Calif.

[73] Assignee: Ecodyne Corporation, Chicago, Ill.

[21] Appl. No.: 239,096

[22] Filed: Feb. 27, 1981

[51] Int. Cl.[3] ..... B05B 1/26

[52] U.S. Cl. ..... 261/111; 261/DIG. 11; 239/521; 239/599

[58] Field of Search ..... 261/111, DIG. 11; 239/521, 523, 598, 599

[56] References Cited

U.S. PATENT DOCUMENTS

| | | | |
|---|---|---|---|
| 1,169,766 | 2/1916 | Brassert | 261/111 |
| 1,228,658 | 6/1917 | Gaines | 239/521 |
| 1,710,832 | 4/1929 | Mart | 261/111 |
| 2,372,466 | 3/1945 | Zvolanek | 239/521 |
| 2,530,671 | 11/1950 | Wahlin | 239/523 |
| 2,574,900 | 11/1951 | Williams et al. | 239/523 |
| 2,738,178 | 3/1956 | Kinney | 261/111 |
| 2,768,101 | 10/1956 | Fairchild | 239/598 |
| 2,921,488 | 1/1960 | Davis | 239/521 |
| 2,997,244 | 8/1961 | Demaison | 239/598 |
| 2,998,934 | 9/1961 | Broughton | 239/521 |
| 3,069,100 | 12/1962 | Schuler | 239/522 |
| 3,237,871 | 3/1966 | Vicard et al. | 239/523 |
| 3,617,036 | 11/1971 | Brown | 261/111 |
| 3,762,650 | 10/1973 | Radecki | 239/536 |
| 3,877,510 | 4/1975 | Tegtmeir et al. | 164/444 |
| 3,974,966 | 8/1976 | Watkins | 239/598 |
| 3,987,713 | 10/1976 | Larkfeldt | 239/598 |
| 4,055,305 | 10/1977 | Schwinn | 261/111 |

FOREIGN PATENT DOCUMENTS

| | | | |
|---|---|---|---|
| 556014 | 4/1958 | Canada | 261/111 |

*Primary Examiner*—Tim R. Miles

*Attorney, Agent, or Firm*—Dressler, Goldsmith, Shore, Sutker & Milnamow, Ltd.

[57] ABSTRACT

A liquid cooling tower has liquid distribution nozzles that spray liquid to be cooled away from the sides of the fill chamber. The spray pattern is restricted to less than about 180°. This prevents liquid from being sprayed out of or on to the tower or from being carried out of or on to the tower by the air flow. The nozzles have a single large liquid discharge opening so that solid objects that flow in with the liquid will not clog them.

12 Claims, 4 Drawing Figures

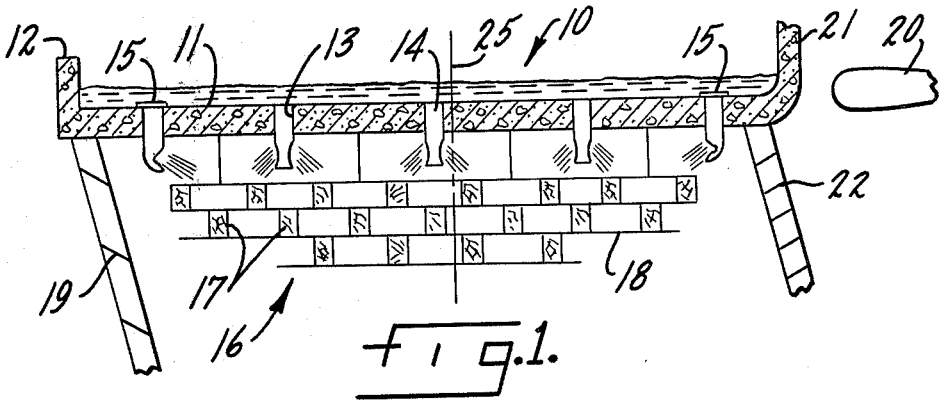
Fig. 1.
Fig. 2.
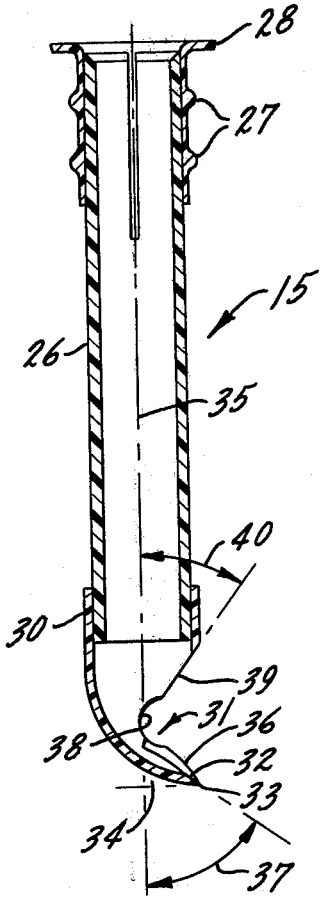
Fig. 3.
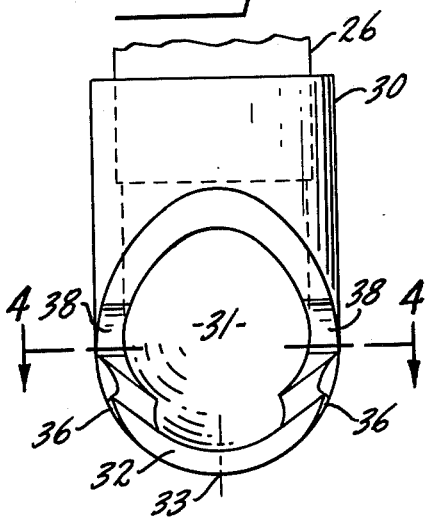
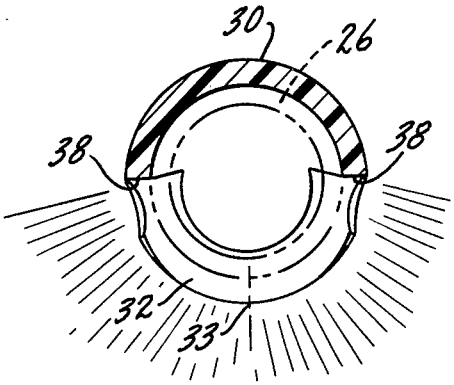
Fig. 4.

COOLING TOWER SPRAY NOZZLE

BACKGROUND OF THE INVENTION

This invention relates to nozzels for mechanical or natural draft liquid cooling towers of the crossflow and conterflow types, and more particularly to improved nozzle structure and placement arrangements.

In cooling towers in which the liquid to be cooled is pumped up to a hot liquid distribution basin, the liquid is disbursed over fill in a cooling chamber through holes in the floor of the basin. Liquid spray nozzles are commonly placed in the holes to aid in attaining uniform dispersion of the hot liquid over the fill. Heretofore, standard cooling tower nozzles have distributed the liquid in essentially 360° circular spray patterns. The result has been that the nozzles close to the entrance and exit sides of the fill chamber sometimes sprayed liquid on the tower structure or out of the tower, or the nozzle spray pattern or direction permitted the air flowing through the tower to carry liquid out with it. It is necessary that the liquid be retained in the fill or cooling chamber to prevent the formation of ice on the structural components of the tower, and to prevent fog or other undesirable environmental effects caused by escaping liquid. It is also necessary for the nozzles to be able to pass solid objects which fall into the basin and enter the nozzles with the flowing liquid. Otherwise, clogged nozzles will prevent uniform distribution of the liquid over the fill, and this will lower the efficiency of the cooling tower.

OBJECTIVES OF THE INVENTION

Accordingly, it is an object of this invention to provide an improved liquid cooling tower and spray nozzle.

Another object is to provide an essentially clog-free nozzle for spraying liquid on to the fill in a cooling tower.

Another object is to prevent liquid from being sprayed out of, or on to the structural parts of a liquid cooling tower.

Another object is to provide an improved cooling tower nozzle for spraying liquid that flows only under the influence of gravity in spray pattern of less than 180°.

Another object is to provide a cooling tower gravitational spray nozzle that is durable, light-weight, corrosion resistant, relatively inexpensive, and easy to replace.

Other objects and advantages of the invention will be apparent from the specification and claims, and the scope of the invention will be set forth in the claims.

DESCRIPTION OF THE DRAWINGS

FIG. 1 is a cross sectional, partially cut-away, schematic representation of a cooling tower in accord with this invention.

FIG. 2 is an enlarged cross sectional side view of an embodiment of the improved nozzle disclosed herein.

FIG. 3 is an enlarged, fragmentary, and elevational view of the bottom portion of the nozzle shown in FIG. 2.

FIG. 4 is a cross sectional view taken along the line 4—4 in FIG. 3.

DESCRIPTION OF A PREFERRED EMBODIMENT

The drawing shows a portion of the upper end of a conventional cross flow mechanical draft cooling tower 10 in which hot water being cooled is pumped into an upper concrete hot water distribution basin 11 surrounded by a retaining wall 12. The water leaves basin 11 through rows of aligned distribution holes 13 containing gravity spray nozzles 14 and 15 and falls into a cooling chamber 16. The water spray contacts and flows over conventional elongated solid splash fill batts 17 held in a conventional wire grid support assembly 18. Air is drawn through louvers 19 at the entrance end of chamber 16 by a rotatable fan 20 in a stack 21. Such air flows through the splash fill and falling water before leaving chamber 16 through drift eliminators 22 at its exit end. The cooled water collects in a basin (not shown) below chamber 16, and is then pumped from tower 10.

This invention provides means for preventing water from escaping from cooling chamber 16. This can be accomplished by restricting some, or all, of the nozzles 15 that are adjacent the air entrance and exit ends of chamber 16 so that the nozzle spray pattern is less than about 180° in a horizontal plane (as indicated in FIG. 4), and so that the spray pattern of nozzles 15 is directed toward the central plane 25 of chamber 16. Each nozzle 15 is an integral unit including an elongated hollow, right circular cylindrical tubular member 26 having flexible tab means 27 at its upper end for anchoring the nozzle in a water discharge opening or hole 13. An anular peripheral rim 28 projects from the upper edge of member 26 so as to extend beyond its associated hole 13. A water flow directing cap 30 is coaxial with and secured to the bottom of member 26. Cap 30 has a generally oval opening 31 in only one of its surfaces or sides. The area of opening 31 is less than about one-third of the surface area of cap 30 so that the spray angle can be limited to less than about 180°. Preferably, the spray angle is limited to between 130° and 170° in a horizontal plane. The longest dimension of opening 31 should be oriented generally vertically as shown in FIG. 3, when nozzle 15 is receiving gravitational water flow. Such longest dimension of opening 31 should be greater than the diameter of tubular member 26 to facilitate passing of solid objects that flow into member 26 with the hot water from basin 11. The bottom inside surface of cap 30 defines an arcuate water flow diverting lip 32. The terminal end 33 of lip 32 extends at an angle 34 of about 90° to the central axis 35 of member 26. The outer dimensions of nozzle 15, including lip 32, should be less than the diameter of the hole 13 in which the nozzle is used to permit insertion and removal of the nozzle from above basin 11.

FIG. 2 is a cross sectional view of nozzle 15 taken in that vertical plane which includes the central axis 35 of member 26 and which also bisects nozzle 15 into two essentially identical halves. When viewed in the plane, oval opening 31 has an edge which defines a line 36 that extends generally upwardly from the terminal end 33 of lip 32 at an angle 37 of about 45° to 60° to central axis 35. Line 36 merges into one end of a substantially semicircular arc 38. The other end of arc 38 merges into a line 39 that extends generally upwardly at another angle 40 of about 30° to 45° to central axis 35. Preferably, angle 37 is 56° and angle 40 is 37°. When oval opening 31 is shaped as described above, it is possible to make corrosion proof, low cost, nozzles 15 from plastic materials such as PVC and ABS.

It has thus been shown that by the practice of this invention, one or more flow restricting nozzles 15 can be used to prevent liquids from being sprayed on to the structural parts of, or out of, a cooling tower 10. Nozzles 15 may be placed only in the liquid discharge holes 13 adjacent to louvers 19 at the air entrance end of cooling chamber 16, or nozzles 15 may be placed only in holes 13 adjacent drift eliminators 22 at the air exit end of chamber 16, depending on wind patterns or other factors determined by cooling tower operating experience. Tubular members 26 may have different lengths so that the liquid can be sprayed around structural components of the tower at the underside of basin 11. The particular design of oval opening 31 and lip 32 of nozzle cap 30 prevents clogging of the nozzle by solids from basin 11, and permits the nozzle spray angle to be accurately predetermined. Also, nozzles 15 may be easily replaced from above chamber 16.

While the present invention has been described with reference to a particular embodiment, it is not intended to illustrate of describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A liquid cooling tower comprising;

A. means defining a liquid cooling chamber having an air entrance end and an air exit end, splash fill member supported within said cooling chamber;

B. means for causing air to flow through said cooling chamber;

C. a hot liquid basin above said cooling chamber, there being a plurality of liquid distribution holes in said basin communicating with the top of said cooling chamber, some of said holes communicating with said chamber adjacent said air entrance end and some of said holes communicating with said chamber adjacent said air exit end;

D. a plurality of gravity liquid spray nozzles having their inlet ends connected to said holes, said nozzles dispersing said hot liquid over said fill members where said hot liquid is cooled by said air flowing through said cooling chamber; and E. means for preventing escape of liquid from said cooling chamber comprising some of said nozzles that communicate with said holes adjacent said entrance and exit ends being restricted nozzles that spray said liquid in a pattern that is not more than about 180° in a horizontal plane, and such liquid spray pattern being directed toward the central plane of said chamber, whereby said liquid is prevented from being sprayed beyond said entrance and exit ends of said cooling chamber.

2. The invention defined in claim 1, wherein said means for preventing escape of said liquid communicates with only holes adjacent said entrance end.

3. The invention defined in claim 1, wherein said means for preventing escape of said liquid communicates with only holes adjacent said exit end.

4. The invention defined in claim 1, wherein said liquid spray angle is between about 130 and 170 degrees.

5. The invention defined in claim 1, wherein said restricted spray nozzles having an open-ended tubular portion extending downwardly from their associated holes for receiving said hot liquid, a liquid flow directing cap on the bottom of said tubular portion, there being an oval opening in only one side of said cap, and said oval opening facing toward said central plane.

6. The invention defined in claim 5, wherein the longest dimension of said oval opening is greater than the diameter of said tubular portion and said longest dimension is generally vertical.

7. The invention defined in claim 5, wherein the terminal end of said cap defines an arcuate liquid flow diverting lip that extends at an angle of about 90° to the central axis of said tubes.

8. The invention defined in claim 7, wherein the outer dimensions of said nozzle including said lip are less than the diameter of said holes, whereby said means for preventing escape of said liquid may be inserted into and removed from said holes from said hot liquid basin above said cooling chamber.

9. The invention defined in claim 7, wherein, when said oval opening is viewed in that vertical plane which includes the central axis of said tubular member and which also bisects said nozzle into two essentially identical halves, the edge of said oval opening defines a line extending generally upwardly from said lip at an angle of 45° to 60° to said central axis, said line extending from said lip merging into one end of a circular arc, the other end of said circular arc merging into a line extending generally upwardly at an angle of 30° to 45° to said central axis.

10. The invention defined in claim 9, wherein said circular arc is a semi-circle.

11. A water cooling tower comprising;

A. means defining a water cooling chamber having an air entrance end and an air exit end, solid splash fill members supported within said cooling chamber;

B. means for causing air to flow through said cooling chamber from said entrance end to said exit end;

C. a hot water basin directly above said cooling chamber, there being a plurality of holes through the bottom of said basin communicating with the top of said cooling chamber, some of said holes being adjacent said air entrance end and some of said holes being adjacent said air exit end;

D. a plurality of gravity liquid spray nozzles having their inlet ends in said holes, said nozzles dispersing said hot water over said fill members where said hot water is cooled by said air flowing through said cooling chamber; and E. means for preventing escape of water from said cooling chamber comprising some of the nozzles in said holes adjacent said entrance and exit ends having an elongated open-ended cylindrical member extending vertically downwardly from such holes for receiving said hot water, a liquid flow directing cap at the bottom of said cylindrical member, there being an oval opening in only one side of said cap for limiting the water spray angle to not more than about 180° in a horizontal plane, the longest dimensions of said oval opening being generally vertical and being greater than the diameter of said cylindrical member, the terminal end of said cap defining an arcuate liquid flow diverting lip extending at an angle of about 90° to the central axis of said cylindrical member, said oval opening facing toward the central plane of said chamber, whereby said water is prevented from being sprayed beyond said entrance and exit ends of said cooling chamber.

12. An integral, plastic, gravity liquid spray nozzle comprising an elongated, hollow, right circular cylindrical member having at its upper end means for anchoring said nozzle in a liquid discharge opening, an annular peripheral rim projecting from the upper edge of said cylindrical member and extending beyond such liquid discharge opening, a liquid flow directing cap at the bottom of said cylindrical member, there being an oval opening in only one side of said cap for limiting the liquid spray angle to not more than about 180° in a horizontal plane, the longest dimension of said oval opening being generally vertical and being greater than the diameter of said cylindrical member, the area of said oval opening being less than about one third of the surface area of said cap, the terminal end of said cap defining an arcuate liquid flow diverting lip the terminal end of which extends at an angle of about 90° to the central axis of said cylindrical member, said oval opening, when viewed in that vertical plane which includes said central axis of said tubular member and which also bisects said nozzle into two essentially identical halves, having an edge which defines a line extending generally upwardly from said terminal end of said lip at an angle of 45° to 60° to said central axis, said line extending from said lip terminal end merging into one end of a substantially semi-circular arc, the other end of said semi-circular arc merging into a line extending generally upwardly at an angle of 30° to 45° to said central axis, the outer dimensions of said nozzle including said lip being less than the diameter of such hole.

* * * * *